US006789742B2

(12) United States Patent
Riley

(10) Patent No.: US 6,789,742 B2
(45) Date of Patent: Sep. 14, 2004

(54) AIR BRUSH APPARATUS

(76) Inventor: William G. Riley, 6200 State Rte. 1241, Hickory, KY (US) 42051

( * ) Notice: Subject to any disclaimer, the term of this patent is extended or adjusted under 35 U.S.C. 154(b) by 0 days.

(21) Appl. No.: 10/243,729

(22) Filed: Sep. 16, 2002

(65) Prior Publication Data

US 2003/0052186 A1 Mar. 20, 2003

Related U.S. Application Data

(60) Provisional application No. 60/323,112, filed on Sep. 19, 2001.

(51) Int. Cl.[7] ..... B05B 15/02; B05B 7/30; F23D 11/34; F23D 11/38; F23D 14/50

(52) U.S. Cl. ..... 239/117; 239/114; 239/116; 239/123; 239/353; 239/319; 239/346; 239/DIG. 14

(58) Field of Search ..... 239/117, 114, 239/116, 123, 353, 319, 346, DIG. 14, 104, 106, 115, 340, 369, 530, 375–379, 290, 291; 251/234

(56) References Cited

U.S. PATENT DOCUMENTS 1,268,403 A * 6/1918 Stacker ..... 239/345
4,020,990 A 5/1977 Luff ..... 239/346
4,742,963 A * 5/1988 Marvaldi ..... 239/337
5,088,903 A 2/1992 Tomatsu ..... 417/473
5,344,120 A * 9/1994 Tam et al. ..... 251/214
5,366,158 A 11/1994 Robisch et al. ..... 239/289
5,687,913 A 11/1997 Robisch et al. ..... 239/346
5,779,157 A 7/1998 Robisch et al. ..... 239/346
5,842,646 A 12/1998 Kitajima ..... 239/345
5,927,602 A 7/1999 Robisch et al. ..... 239/1
5,961,050 A 10/1999 Kitajima ..... 239/346
6,341,736 B1 * 1/2002 Liao ..... 239/375
6,425,536 B2 * 7/2002 Namura ..... 239/390

FOREIGN PATENT DOCUMENTS

GB 1587898 3/1978 ..... B05B/7/08

* cited by examiner

*Primary Examiner*—Michael Mar
*Assistant Examiner*—Darren Gorman
(74) *Attorney, Agent, or Firm*—Richard C. Litman

(57) ABSTRACT

An air brush apparatus that is made up of a head assembly, a shell assembly, an air valve assembly for controlling the compressed air which is fed into the apparatus, a handle assembly, a lever assembly, and a paint regulating needle, with a distal end and a proximal end, being movably inserted into the handle assembly and through the air valve assembly and into the head assembly. The paint regulating needle can be cleaned by simply twisting the handle assembly. The apparatus also is designed with a more comfortable and ergonomic lever handle assembly.

2 Claims, 3 Drawing Sheets

AIR BRUSH APPARATUS

CROSS-REFERENCE TO RELATED APPLICATION

This application claims the benefit of U.S. Provisional Patent Application Serial No. 60/323,112, filed Sep. 19, 2001.

BACKGROUND OF THE INVENTION

1. Field of the Invention

The present invention relates to an improved air brush apparatus that is easier to clean and more comfortable to use.

2. Description of Related Art

Air brush devices are important tools for artisans to produce high quality automotive, van, motorcycle and other vehicle art. These devices are able to produce painted images better than an artisan can create using a regular brush. These devices can also be difficult to clean and difficult to use over a long period of time. The related art describes a number of air brushes that have a variety of features.

U.S. Pat. No. 4,020,990 issued to Luff, describes the use of an air brush with a spray head which carries a liquid spray nozzle that is fed from a tube into a liquid reservoir. An air jet is positioned adjacent the spray nozzle and mechanism for conducting pressure air from a source to the air jet to cause a stream of air past the spray jet where a negative pressure induced at the spray jet which draws liquid from the reservoir and into the air stream where it is entrained as minute droplets.

U.S. Pat. No. 5,088,903 issued to Tomatsu, describes the use of a small and lightweight compressor which has a motor which generates rotational drive, which is converted into reciprocating movement to actuate an air compressing mechanism to discharge compressed air. Three or more air compressing members are successively operated with a phase difference therebetween to continuously discharge a smooth current of compressed air out of a discharge hole. The compressor can be part of a spray apparatus with an air brush in which a movable needle is inserted in a liquid path.

U.S. Pat. No. 5,366,158 issued to Robisch et al., describes the use of an air brush which comprises a handle and a front body. The handle and the front body together define a tubular cavity through which air may travel. The air brush defines a longitudinal axis. The front body is rotationally connected to the handle in such a way that the tubular cavity is in communication through the handle and the front body as the front body is rotated about the longitudinal axis of the air brush.

U.S. Pat. No. 5,687,913 issued to Robisch et al., describes the use of an air brush provided with a handle, a front body, an adjusting screw and a paint regulating needle. The handle, front body and the adjusting screw together define a tubular cavity through which the paint regulating needle is held. One end of the paint regulating needle extends outside of the handle and defines a stop which the adjusting screw cannot pass and its other end extends through the handle and the front body. A spring biases the paint regulating needle forward so that paint cannot flow out of the front body until desired.

U.S. Pat. Nos. 5,779,157 and 5,927,602 issued to Robisch et al., describe an air brush provided with a handle, a front body and a paint regulating needle. The handle and the front body together define a tubular cavity through which the paint regulating needle is carried. A needle chuck releasably holds the paint regulating needle in the tubular cavity. The handle further defines a portal through which the needle chuck may be accessed.

U.S. Pat. No. 5,842,646 issued to Kitajima, describes the use of an air brush with a function of spraying an ink coating of a writing material, a holder holding attachably and detachably a writing material, which is mounted to an air brush main body having a coating storing vessel and a brush tip of the writing material. The holder is adjacently disposed directly in front of a nozzle of the air brush main body at a predetermined angle of inclination where the ink coating impregnated in the brush tip is atomized by impinging a jet stream from the nozzle onto the brush tip.

U.S. Pat. No. 5,961,050 issued to Kitajima, describes the use of an air brush which has a function to improve a maintenance work characteristic within the air brush's main body and is capable of selectively realizing a plurality of different blowing injection forms. The air brush's main body is separated between the coating material container and the air supplying port so as to separate into the nozzle container unit at the extreme end of the main body and the residual main body unit.

Great Britain Pat. No. 1,587,898 granted to SKM, relates to a method of atomizing liquid products and also to a spray gun for carrying out this method. The method and spray gun according to this invention are intended more particularly, but not exclusively for atomizing and spraying paints and varnishes.

All of the devices described in these patents are useful. However, what is really needed is an air brush that is not only easy to clean, but also is more comfortable to use than current double-action air brushes. It is not uncommon for a user to be uncomfortable while using an air brush for an extended period of time, and painters and other users would welcome a better designed and more comfortable air brush.

None of the above inventions and patents, taken either singly or in combination, is seen to describe the instant invention as claimed.

SUMMARY OF THE INVENTION

The invention is an air brush apparatus that is made up of a head assembly, a shell assembly, an air valve assembly for controlling the compressed air which is fed into the apparatus, a handle assembly, a lever assembly, and a paint regulating needle, with a distal end and a proximal end, being movably inserted into the handle assembly and through the air valve assembly and into the head assembly. The paint regulating needle can be cleaned by simply twisting the handle assembly. The apparatus also is designed with a more comfortable and ergonomic lever handle assembly.

Accordingly, it is a principal object of the invention to provide an improved air brush apparatus that is easy to clean.

It is another object of the invention to provide an improved air brush apparatus that is more comfortable to use.

It is a further object of the invention to provide an improved air brush apparatus that is easier to use over an extended period of usage.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
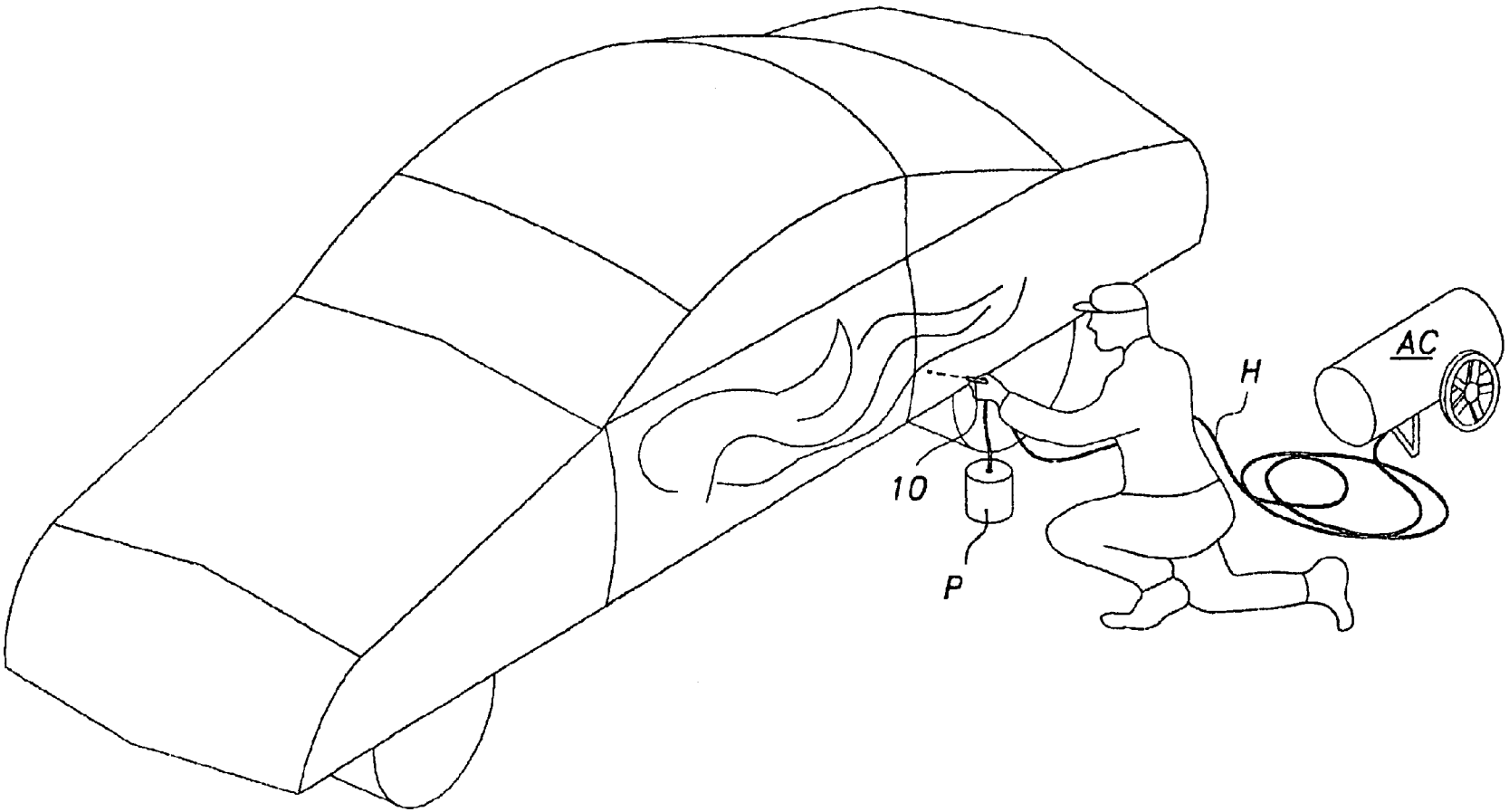
FIG. 1 is an environmental, perspective view of an improved air brush apparatus according to the present invention.

The present invention is an improved air brush apparatus 10, as depicted in FIG. 1. The air brush apparatus 10 is used with a compatible air compressor AC, hose H and paint source P in order to function properly. The air compressor AC, hose H and paint source P are entirely conventional and form no part of the instant invention per se.

The air brush apparatus 10 comprises a head assembly 20, a shell assembly 30, an air valve assembly 40, a lever assembly 50, a handle assembly 60 and a paint regulating needle 70. The paint regulating needle 70 is inserted into the handle assembly 60 and continues through the air valve assembly 40 and into the head assembly 20. The head assembly 20, the paint regulating needle 70 and the air valve assembly 40 are conventional and are well-known in the art.

Figure 2:
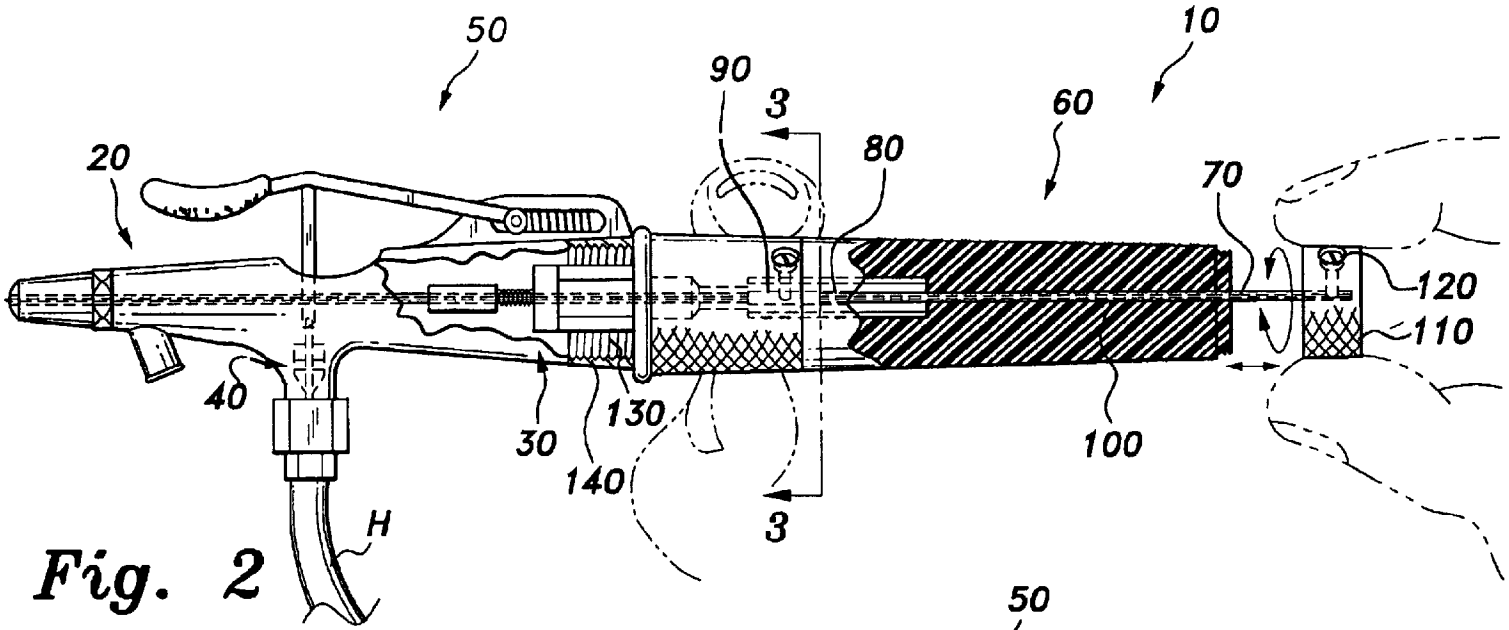
FIG. 2 is an elevational side view of the improved air brush apparatus.

A point of novelty with the air brush apparatus 10 is in the handle assembly 60, as illustrated in FIG. 2. The handle assembly 60 is a solid handle with a polygon aperture 90 that is bored out of the proximal end of the handle assembly 60. The polygon aperture 90 is mated with a polygon needle adjusting protrusion 80 from the lever assembly 50. A more narrow pathway 100 is also bored out from the distal end of the polygon aperture 90 to the distal end of the handle assembly 60. The polygon needle adjusting protrusion 80 is also bored out through the lever assembly 50 and head assembly 20. This narrow pathway 100 is to accommodate the insertion of the paint regulating needle 70 through the handle assembly 60 and into the lever assembly 50 and head assembly 20.

The outside distal end 110 of the handle assembly 60 is knurled for easier grasping for turning the entire handle assembly 60. There is also a pilot screw 120 that holds the proximal end of the paint regulating needle 70 while the paint regulating needle 70 is in the air brush apparatus 10. The proximal end 130 of the handle assembly 60 is threaded to mate with the interior threads 140 from the lever assembly 50 section of the air brush apparatus 10. The pilot screw 120 and the outside distal end 110 can also be grabbed and pulled back to clean the end of the needle 70 as well, which is a point of novelty and convenience for the user. The entire handle assembly 60 can be twisted and moved back and forth along the proximal end threads 130 and the interior threads 140. This in turn moves the distal end of the paint regulating needle 70 within the head assembly 20 of the air brush apparatus 10 back and forth to clear any clogs from any dried paint debris on the distal end of the paint regulating needle 70 that can accumulate within the head assembly 20. The entire handle assembly 60 can also be used on other air brush apparatuses and be sold separately.

This is an easier way to clear the distal end of the paint regulating needle 70 than the traditional method of having to remove the paint regulating needle 70 all together and clear the head assembly 20 with a needle plunger (not shown). This is a cleaning means for cleaning the distal end of the paint regulating needle 70, which is the handle assembly 60 being rotated to move the distal end of the paint regulating needle 70 back and forth within the head assembly 20. Further cleaning can be achieved by grasping the outside distal end 110 of the handle assembly 60 and pulling the paint regulating needle 70 back and forth.

There is also an easier way to clean the air brush apparatus 10 then the cleaning method described in U.S. Pat. No. 5,961,05 issued to Kitajima. The cleaning method described in this patent involves the tedious task of having to pinch and twist the paint regulating needle 70, instead of simply providing a quick twist and turn to clean the paint regulating needle 70 of this air brush apparatus 10.

Figure 3:
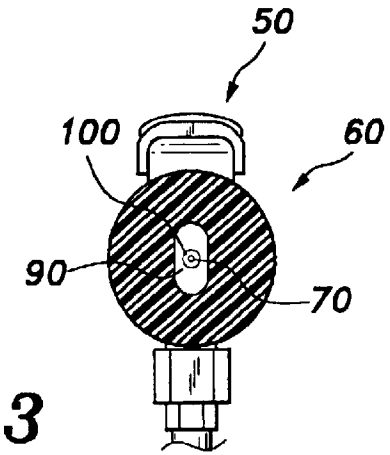
FIG. 3 is a cross-sectional view taken along lines 3—3 of FIG. 2.

A cross-section of FIG. 2 along line 3—3 is illustrated in FIG. 3. FIG. 3 illustrates the narrow pathway 100, the polygonal-shaped aperture 90 and the paint regulating needle 70 in relation to the handle assembly 60. Note that the depth of the polygonal aperture 90 is an oval shape and is only deep enough to accommodate the size of the polygonal needle adjusting protrusion 80. The polygonal aperture 90 can be any shape (square, circle, rectangular, triangular, quadrilateral, pentagon, hexagonal, octagonal or any other polygon) as long as it mates with the shape of the corresponding polygonal needle adjusting protrusion 80. The polygonal aperture 90 must be the same approximate shape as the polygonal needle adjusting protrusion 80. The entire handle assembly 60 is one solid piece that has the polygonal aperture 90 and narrow pathway bored out to accommodate the paint regulating needle 70. The polygonal needle adjusting protrusion 80 is also bored out to accommodate the paint regulating needle 70 and allow the paint regulating needle 70 to run through the lever assembly 50.

Figure 4:
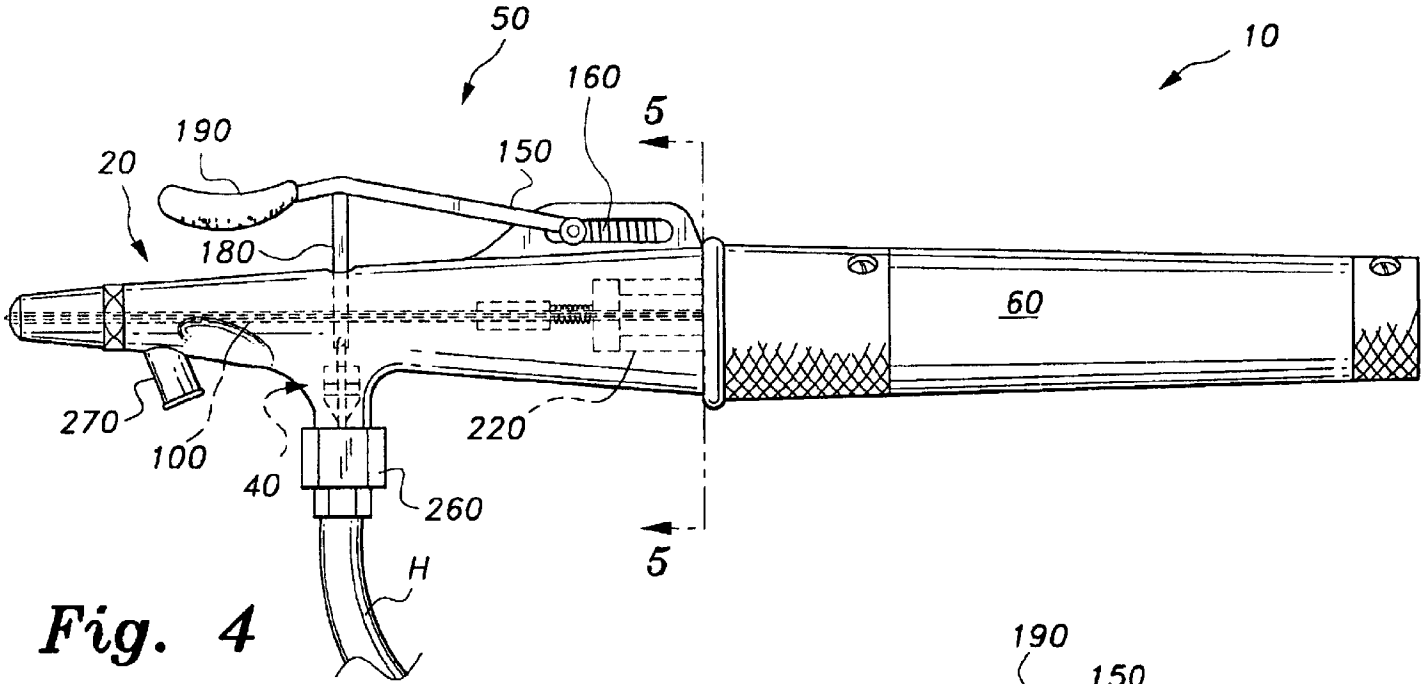
FIG. 4 is an elevational side view of the control lever of the improved air brush apparatus.

FIG. 4 illustrates a second novel feature of the air brush apparatus 10, which is a novel lever assembly 50. The lever assembly 50 is comprised of a lever handle 150, a spring biased mechanism 160 for the lever handle 150 and a moving hinge 180 that controls the air valve assembly 40.

This lever assembly 50 is designed with a lever handle 150 that is more comfortable and ergonomically designed than the smaller push button control (not shown) that is frequently used in the related art to control the air valve assembly 40. The lever handle 150 is provided with a rubber end 190 for greater feel and comfort. The lever handle 150 is designed to move back and forth and is a double action lever handle. The spring bias mechanism 160 keeps the lever handle 150 in line and allows the lever handle 150 to move back and forth. The lever assembly 50 is designed for air brush users who must use the air brush apparatus 10 for long extended periods of time, and helps these users fight fatigue.

The moving hinge 180 is integral to the top of the air valve assembly 40 and controls the air valve assembly 40, which controls the flow of paint for the air brush apparatus 10. The entire lever assembly 50 is housed and situated above and within the shell assembly 30.

Figure 5:
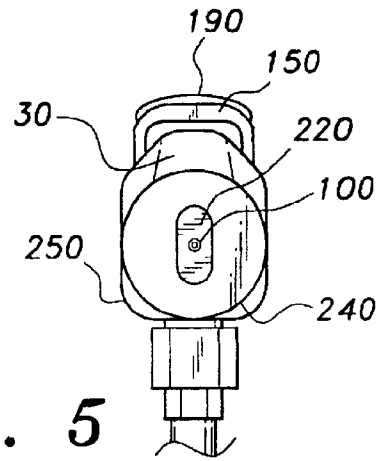
FIG. 5 is a cross-sectional view taken along lines 5—5 on FIG. 4 of the improved air brush apparatus.

FIG. 5 depicts a third novel feature of the air brush apparatus 10, which is the shape and design of the shell assembly 30. A cross-section of the shell assembly 30 is depicted in FIG. 5. The cross-section shows a base part of the paint regulating needle adjusting protrusion 220 along with the narrow pathway 100 in the handle assembly 60. The top of FIG. 5 shows the top of the shell assembly 30, in addition to the lever handle 150 and the rubber end of the lever handle 190. Note that the inner shape of the handle assembly 240 is round. However, the outside surface of the handle assembly 250 is a rounded off square shape, enabling the user of the air brush apparatus 10 a comfortable and stable grip.

Use of the air brush apparatus 10 is uncomplicated. A user first attaches an air compressor AC, hose H and paint source P to the air brush apparatus 10. The hose H is attached to the air valve assembly nozzle 260 and the paint source P is attached to the head assembly nozzle 270. Once attached, the air brush apparatus 10 is ready for use.

Varying amounts of paint are dispersed by the degree of force placed on the lever assembly 50. When the paint regulating needle 70 of the air brush apparatus 10 is clogged, the user can simply twist the handle assembly 60 back and forth to loosen any clogged paint that might be present. Further cleaning can be achieved by grasping the outside distal end 90 of the handle assembly 60 and pulling the paint regulating needle 70 back and forth. This is a much easier and convenient way to clean the end of the paint regulating needle 70 than having to remove the paint regulating needle 70 entirely and use a needle plunger (not shown) to clean the head assembly 20. Clogging is a common occurrence in the normal use of any air brush apparatus. Therefore, addressing the clogging problem is very important to the efficient operation of the air brush apparatus 10.

It is to be understood that the present invention is not limited to the embodiments described above, but encompasses any and all embodiments within the scope of the following claims.

I claim:

1. A handle assembly for use with an air brush apparatus having an air brush head assembly with a threaded end and a needle adjusting member, the handle assembly comprising:

a substantially cylindrical handle formed of a substantially unitary material, having a first end and a second end with an outside diameter, the substantially cylindrical handle defining a centrically located longitudinal throughbore having a first diameter extending from said second end, said substantially cylindrical handle also defining an aperture having a non-circular perimeter extending partially into the handle from the first end thereof, and being coextensive with the throughbore, and said first end of the handle having a threaded portion for matingly engaging the threaded end of the air brush head assembly;

a needle adjusting protrusion member adapted to be threadedly engaged to the needle adjusting member of the air brush head assembly, said needle adjusting protrusion member having a central opening and substantially non-circular perimeter; and a paint regulating needle having an outside diameter substantially equivalent to the diameter of the throughbore, with a distal end and a proximal end, the needle being movably inserted into the handle throughbore, the distal end having a diameter substantially equivalent with the throughbore of said handle, the distal end being disposed adjacent the second end of the handle;

the distal end of said needle having a knurled circumferential surface having a diameter equivalent to the outside diameter of said second end of said cylindrical handle;

the proximal end of said needle extends from and beyond the first end of the handle and through the central opening of said needle adjusting protrusion member;

wherein the non-circular perimeter aperture of the handle assembly matingly engages the substantially non-circular perimeter of the needle adjusting protrusion member when received within the handle for selectively securing said needle in the needle adjusting member;

whereby, when the protrusion member threadedly engages the needle adjusting member of the air brush apparatus and the handle assembly is threadedly connected to air brush head assembly and rotated counterclockwise less than 180° upon the threaded end of the air brush head assembly, the paint regulating needle is selectively released to reciprocally slide within the throughbore and the air brush head assembly for cleaning the air brush apparatus without disassembling the handle assembly from the air brush head assembly.

2. The apparatus according to claim 1, wherein the non-circular aperture of the handle has the same approximate shape as the non-circular needle adjusting protrusion member.

* * * * *